United States Patent [19]

Hind

[11] 3,970,283

[45] July 20, 1976

[54] POURING OF MOLTEN METALS

[75] Inventor: Robert Duncan Hind, Rotherham, England

[73] Assignee: United States Steel Corporation, Pittsburgh, Pa.

[22] Filed: Jan. 9, 1975

[21] Appl. No.: 539,667

[30] Foreign Application Priority Data

Jan. 15, 1974 United Kingdom ..... 1913/74

[52] U.S. Cl. ..... 251/144; 251/155; 137/329; 222/559

[51] Int. Cl.[2] ..... B65D 47/00; B67D 3/02

[58] Field of Search ..... 251/155, 156, 144; 74/417; 294/110; 137/329.06, 329.00; 222/370, 548, 559, 561, 567, 566

[56] References Cited

UNITED STATES PATENTS

| | | | |
|---|---|---|---|
| 1,223,749 | 4/1917 | Wafer et al. | 251/155 X |
| 3,430,644 | 3/1969 | Lyman | 251/144 X |
| 3,841,539 | 10/1974 | Shapland, Jr. et al. | 251/144 X |

FOREIGN PATENTS OR APPLICATIONS

| | | | |
|---|---|---|---|
| 1,155,082 | 7/1956 | France | 251/144 |

*Primary Examiner*—William R. Cline
*Assistant Examiner*—Robert J. Miller
*Attorney, Agent, or Firm*—Walter P. Wood

[57] ABSTRACT

A sliding gate valve has a sliding plate provided with an under-hung insulating member having a hollow nose, the hollow nose having a tapered bore in which a molten metal resistant liner is cemented, the liner being tapered to fit the bore and a frangible cement being used to detachably secure the liner in the nose so that the liner can be readily replaced when worn.

3 Claims, 3 Drawing Figures

POURING OF MOLTEN METALS

Figure 1:
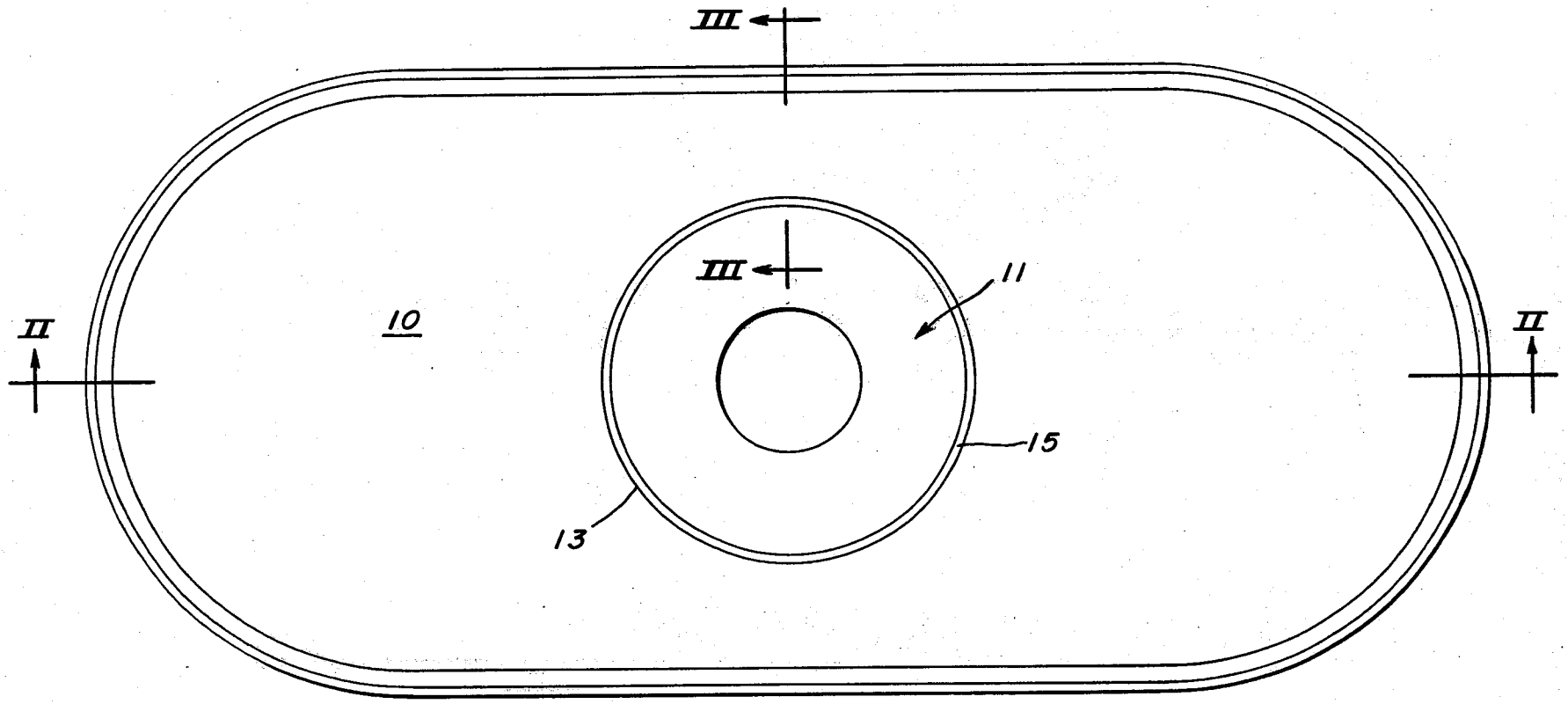

Prior Application: Priority Great Britain Jan. 15, 1974. Application No. 1913/74.

This invention is concerned with improvements in or relating to the pouring of molten metals.

In a process for the pouring of molten metals such as steel, for example in continuous casting, the flow of molten steel from a bottom pour ladle or tundish may be controlled by a sliding gate valve assembly, in which a sliding gate member having a nozzle is arranged to slide in contact with a stationary orifice plate. Examples of such sliding gate valve assemblies are described in Shapland Reissue U.S. Pat. Nos. 27,237 and 3,501,068, Shapland et al application Ser. No. 377,385 filed July 9, 1973, and Cudby application Ser. No. 380,808, filed July 19, 1973 (now U.S. Pat. No. 3,904,566). The foregoing patents and applications are concerned with arrangements in which the sliding gate member is linearly reciprocable. In an alternative arrangement the sliding gate is rotary and one example of this is described in Lyman U.S. Pat. No. 3,430,644. The foregoing patents and applications and the present application are of common ownership.

Discharge nozzles associated with sliding gate valves are prone to rapid deterioration owing to the rigours of their service conditions. They are subject to wear or erosion and nozzle blockage and the rate of deterioration depends, inter alia, upon the nature of the metal being poured.

Hitherto, replacement of gate valve parts and discharge nozzles has been costly and inconvenient, and accordingly the chief aim of this invention is to provide a construction which facilitates servicing.

According to the present invention, there is provided a sliding plate for a sliding gate valve, wherein the sliding plate includes a discharge nozzle and the assembly comprises a refractory sliding plate member, an insulating member having a nose provided with a tapered bore carried by the plate member and a frusto-conical nozzle liner which is cemented within the tapered bore, the liner having a taper conforming to that of the bore and the liner extending through an orifice in the plate member, the liner terminating flush with the exterior sliding surface of the plate member.

Conveniently, the insulating member is a refractory casting.

Preferably, the tapers of the bore and nozzle liner are such as to converge inwardly in the direction away from the plate member. Installation of the liner is carried out discharge-end first from the sliding surface of the plate member, therefore. A cement is chosen which provides a frangible bond between liner and bore, to enable the liner to be forced out of the bore when replacement is necessary. Removal of the liner is in the opposite direction from installation. Thus, the discharge end of the liner is forced in the direction of the plate member.

The invention also comprehends a sliding plate valve, and a bottom or side-pour vessel such as a ladle or tundish, provided with a valve having a replaceable, tapered nozzle liner. The invention furthermore comprehends method aspect concerning the installation and replacement of tapered nozzle liners.

Figure 2:
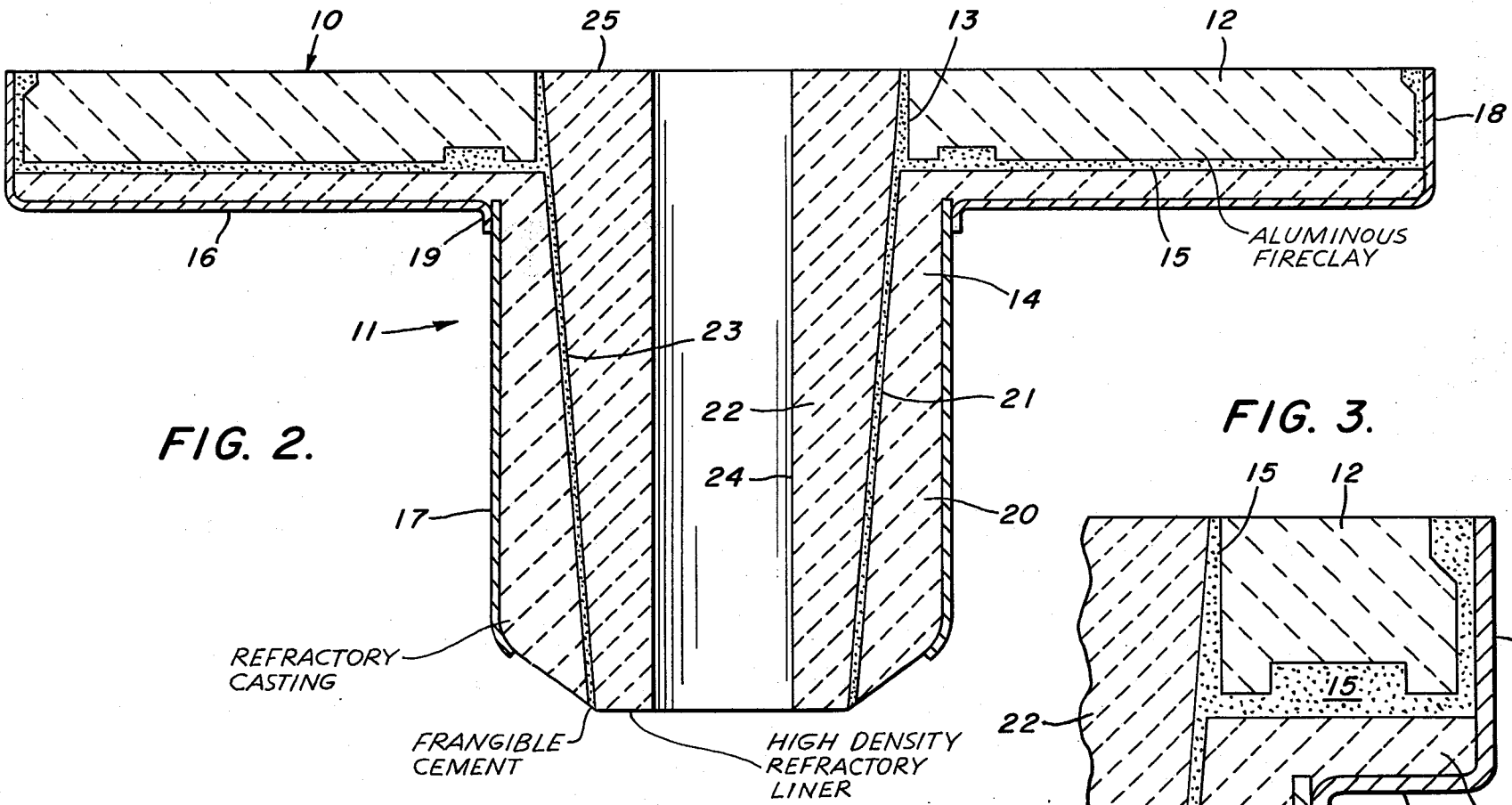
Figure 3:
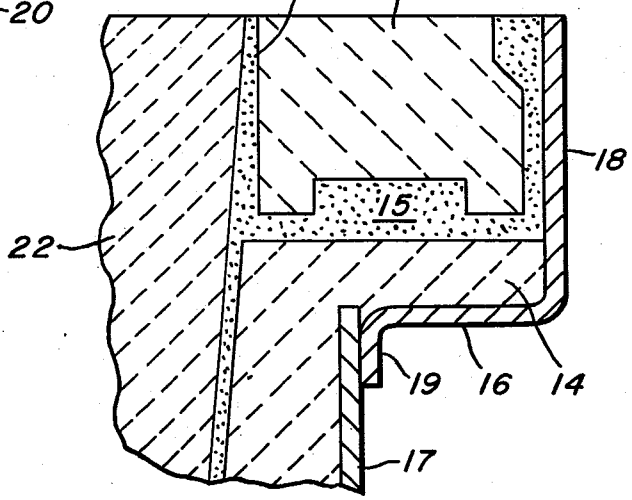

An embodiment of the present invention will now be described by way of example with reference to the accompanying drawings, in which:

FIG. 1 is a top plan view of a gate valve sliding plate embodying a replaceable collector nozzle, FIG. 2 is a transverse sectional view taken along the lines II—II of FIG. 1, and FIG. 3 is another transverse sectional view taken, at right angles to the view of FIG. 2, along the lines III—III of FIG. 1.

The drawings illustrate one part of a sliding gate valve assembly. The valve assembly as a whole is disclosed fully in the patent specifications referred to hereinbefore. The illustrated part comprises the sliding plate 10 and a collector nozzle indicated generally by numeral 11. The sliding plate 10 includes a flat, high-density alumina refractory member 12 which in this case is oval in shape. The refractory material can be 85–90% $Al_2O_3$. The collector nozzle 11 is centrally located, coaxial with an opening 13 in the sliding plate 10.

The sliding plate 10 also includes an insulator comprising a refractory casting 14 which is bonded to the underside of the member 12 by a layer of cement 15. The casting 14 can be made from a material such as 40% or 60% aluminous fireclay. The material could, alternatively, be 70–90% alumina or any of the other materials commonly chosen for this purpose. The cement 15 can be of a heat or air setting type.

The plate member 12 and casting 14 are reinforced by an apertured metal pan or tray 16 and a metal sleeve 17. The pan 16 contacts the underside of the casting 14 and has a flange 18 extending around and bonded to the periphery of the sliding plate 10. The sleeve 17 is embraced by an inner lip 19 of the pan 16 encircling the aperture therein. The sleeve and pan may be welded or brazed together. The sleeve 17 snugly embraces a nose portion 20 of the casting 14.

A bore passes through the casting 14 from top to bottom. The wall 21 of the bore tapers inwardly towards the bottom end of the nose 20, at which point the bore is of minimum internal diameter. A liner 22 of the collector nozzle 11 is cemented in the bore of the casting. The liner is frusto-conical and has a tapering radially outer surface 23 which conforms to the tapering wall 21. A parallel-sided passage passes through the liner 22. This passage 24 serves to produce a well-defined stream of molten metal when the gate valve is opened.

It will be seen that the top end of the liner 22 is flush with the sliding surface 25 of the sliding plate member 12.

The cement bonding the liner 22 to the inner wall 21 of the nose 20 should be sufficiently weak to allow the liner 22 to be removed for replacement thereof.

Assembly of the sliding plate 10 and nozzle 11 is quite straightforward. The tapered liner 22 is inserted from through the aperture 13 in the plate member 12. Initially, the liner 22 is made overlong and is then ground to length after the cement bonding it to the nose 20 has set. It is essential that the upper, large end of the liner 22 is flush with the sliding surface of the plate member 12, otherwise proper sealing of the gate valve would be impossible.

Deterioration of the liner 22 occasioned during use necessitates its periodic replacement. Removal of the liner 22 is a simple matter: all that is needed is to force the liner 22 upwardly, for example using a press drift or mandrel, thereby breaking the cement bond. After clearing residual cement adhering to the wall 21, a fresh liner can be installed, and the upper surface can be re-ground if necessary to make flush with the sliding surface 25 of the plate 12 and to clean up the sliding surface generally.

The liner 22 is made from a refractory material able to withstand high temperatures and erosion or wear by flowing metal. It could be a high-density refractory including 86–90% alumina, zirconia or other refractory materials commonly used for collector nozzles.

When throttling the flow of molten metal with a sliding gate valve provided with a sliding plate embodying the invention, the nozzle and its liner are subjected to erosion and wear. Wear is greatest at the upper end of the liner. The present construction is particularly advantageous since the thickness of the liner is greatest where wear is greatest. The more pronounced the taper of the liner, the more liner material will be present in the region where wear is greatest. Thus, a pronounced taper is preferred so as to maximise the times between liner replacement.

In principle, the liner can be enlarged locally in its wear-subjected region. Thus, the liner can have a major part tapered as shown in FIG. 2, and its upper portion can be more steeply tapered or divergent to provide an enlargement. In this modification, the opening 13 of the plate 10 would be suitably widened and shaped to accommodate the liner enlargement. The enlargement could alternatively be formed by a deep, encircling flange at the plate end of the nozzle liner.

It will be noticed from FIG. 1 that the plate 10 is of oval outline, whereas the liner 22 visible in that Figure is of circular outline. The liner 22 can advantageously be modified to have an enlarged upper portion which is of oval outline similar to the plate, again to enhance the longevity of the liner against the effects of erosion and wear.

Accordingly, the liner could comprise a main tubular refractory body the inner wall of which is lined by a second refractory material which has greater resistance to slag and molten metal attack and erosion than the main body, the second refractory material extending at least half-way along the liner from the end thereof which is flush with the sliding surface of the plate member. The second refractory material of the liner may have a heat capacity of the same order as fireclay and could comprise zirconia, zircon or materials containing zirconia or zircon.

The nozzle 11 and liner 22 could also incorporate features disclosed in co-pending patent application Ser. No. 524,916 filed Dec. 15, 1974, in which case the liner would be made gas-permeable and a gas inlet would be provided in the nose to admit gas to the liner.

I claim:

1. In a sliding gate which includes a refractory sliding plate having an orifice, and a collector nozzle extending from said plate in line with said orifice, the improvement in which said nozzle comprises:

an insulating tubular refractory member having a downwardly tapered bore;

a tubular liner of erosion-resistant refractory within said tapered bore and having a conforming downwardly tapered outer surface and a cylinderical bore; and a layer of frangible refractory cement between the tapered surfaces of said tapered bore and said liner affixing said liner within said member;

said liner being readily removable from said member on breaking of said cement.

2. A gate as defined in claim 1 in which said liner extends through said plate and has an end face flush with the face of said plate.

3. A gate as defined in claim 1 comprising in addition a reinforcing metal pan encasing said plate and a metal sleeve fixed to said pan and encasing said member.

* * * * *